US006316400B1

(12) United States Patent
Del Duca et al.

(10) Patent No.: US 6,316,400 B1
(45) Date of Patent: Nov. 13, 2001

(54) LIQUID BLEACHING COMPOSITION WITH IMPROVED SAFETY TO FABRICS AND COLORS

(75) Inventors: Valerio Del Duca, Massalubrense; Stefano Giunti, Fermignano; Sabina Antonioli, Rome, all of (IT)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/509,915

(22) PCT Filed: Oct. 7, 1998

(86) PCT No.: PCT/US98/21240

§ 371 Date: Jun. 19, 2000

§ 102(e) Date: Jun. 19, 2000

(87) PCT Pub. No.: WO99/18179

PCT Pub. Date: Apr. 15, 1999

(30) Foreign Application Priority Data

Oct. 8, 1997 (EP) ..... 97870151

(51) Int. Cl.[7] ..... C11D 3/395; C11D 3/60

(52) U.S. Cl. ..... 510/375; 510/376; 510/378

(58) Field of Search ..... 510/375, 376, 510/378, 367, 422, 490

(56) References Cited

U.S. PATENT DOCUMENTS

| | | | | |
|---|---|---|---|---|
| 4,490,536 | | 12/1984 | Corti et al. | 548/112 |
| 5,484,531 | * | 1/1996 | Kuehne et al. | 210/263 |
| 6,235,699 | * | 5/2001 | Del Duca et al. | 510/375 |

FOREIGN PATENT DOCUMENTS

| | | | |
|---|---|---|---|
| 1398253 | 6/1975 | (GB) | C11D/3/60 |
| 08120295A | 10/1994 | (JP) | C11D/3/395 |
| WO 97/12856 | 4/1997 | (WO) | C07C/231/12 |
| WO 97/31093A | 8/1997 | (WO) | C11D/3/48 |

* cited by examiner

*Primary Examiner*—Yogendra N. Gupta
*Assistant Examiner*—John M Petruncio
(74) *Attorney, Agent, or Firm*—Richard S. Echler, Sr.; Kim W. Zerby; Steven W. Miller

(57) ABSTRACT

The present invention relates to a liquid bleaching composition comprising a peroxygen bleach and a salt free zwitterionic betaine surfactant. These compositions are suitable to deliver excellent stain removal performance and bleaching performance on fabrics, with improved safety to the fabrics and colors especially under pretreatment conditions.

20 Claims, No Drawings

LIQUID BLEACHING COMPOSITION WITH IMPROVED SAFETY TO FABRICS AND COLORS

TECHNICAL FIELD

The present invention relates to the bleaching of fabrics.

BACKGROUND

Peroxygen bleach-containing compositions have been described in laundry applications as laundry detergents, laundry additives or even laundry pretreaters.

Indeed, it is known to use peroxygen bleach-containing compositions comprising surfactants like zwitterionic betaine surfactants in laundry applications to boost the removal of encrustated stains/soils which are otherwise particularly difficult to remove, such as grease, coffee, tea, grass, mud/clay-containing soils and the like. However, we have found that a drawback associated with such peroxygen bleach-containing compositions comprising such surfactants is that said compositions may damage fabrics and/or colors, resulting in loss of tensile strength and/or color change/decoloration, especially when used in laundry pretreatment application, e.g., when applied directly (neat) onto the fabrics, and left to act onto said fabrics for prolonged periods of time before rinsing the fabrics, or washing and then rinsing the fabrics.

It is thus an object of the present invention to provide improved fabric safety and color safety upon bleaching, especially in pretreatment applications where the compositions are left neat into contact with the fabrics for prolonged periods of time before rinsing the fabrics, or washing and then rinsing the fabrics.

It has now been found that improved fabric safety and color safety can be achieved by formulating a liquid bleaching composition comprising a peroxygen bleach and a salt free zwitterionic betaine surfactant. Indeed, it is by combining these ingredients that a liquid bleaching composition is provided which exhibits a great flexibility in the soils it may clean while being safe to the fabrics bleached therewith as well as to colors. Indeed using such salts free zwitterionic betaine surfactants instead of conventional zwitterionic betaine surfactants provides improved color and fabric safety.

Advantageously, the present compositions also provide effective stain removal performance on various stains including greasy stains and effective bleaching performance.

In a preferred embodiment these salts free zwitterionic betaine surfactants are used in combination with ethoxylated nonionic surfactants. It has been found that the addition of such an ethoxylated nonionic surfactant in the compositions of the present invention further boosts the removal of various types of stains including greasy stains like mayonnaise, vegetal oil, sebum, make-up, and more surprisingly boost the bleaching performance.

Advantageously, the compositions of the present invention provide excellent stain removal performance on a broad range of stains and soils and excellent bleachable performance when used in any laundry application, e.g., as a laundry detergent or a laundry additive, and especially when used as a laundry pretreater, or even in other household applications like in hard surface cleaning applications.

A further advantage is that the compositions herein are physically and chemically stable upon prolonged periods of storage.

Yet another advantage of the compositions according to the present invention is that they are able to perform in a variety of conditions, i.e., in hard and soft water as well as when used neat or diluted.

SUMMARY OF THE INVENTION

The present invention encompasses a liquid bleaching composition comprising a peroxygen bleach and a salt free zwitterionic betaine surfactant.

The present invention also encompasses the use of a salt free zwitterionic betaine surfactant, in a liquid peroxygen bleach-containing composition, for the bleaching of fabrics, for reducing the loss of tensile strength in said fabrics.

The present invention also encompasses the use of a salt free zwitterionic betaine surfactant, in a liquid peroxygen bleach-containing composition, for the bleaching of fabrics, for reducing color damage to said fabrics.

The present invention further encompasses processes of bleaching fabrics starting from a liquid composition as defined herein. The processes of bleaching fabrics include the steps of contacting said fabrics with the liquid composition herein neat or diluted, and subsequently rinsing said fabrics. In the preferred embodiment, when the fabrics are "pretreated", the composition is applied neat on the fabrics, and the fabrics are subsequently washed in a normal wash cycle.

DETAILED DESCRIPTION OF THE INVENTION

The Liquid Cleaning Composition

The compositions according to the present invention are liquid compositions as opposed to a solid or a gas. As used herein "liquid" includes "pasty" compositions. The liquid compositions herein are preferably aqueous compositions. The liquid compositions according to the present invention preferably have a pH up to 7, more preferably from 1 to 6, and even more preferably from 1.5 to 5.5. Formulating the compositions according to the present invention in the acidic pH range contributes to the chemical stability of the compositions and to the stain removal performance of the compositions. The pH of the compositions may be adjusted by any acidifying agents known to those skilled in the art. Examples of acidifying agents are organic acids such as citric acid and inorganic acids such as sulphuric acid.

Peroxygen Bleach

As a first essential element the compositions according to the present invention comprise a peroxygen bleach or a mixture thereof. Indeed, the presence of peroxygen bleach contributes to the excellent bleaching benefits of said compositions. Suitable peroxygen bleaches to be used herein are hydrogen peroxide, water soluble sources thereof, or mixtures thereof. As used herein a hydrogen peroxide source refers to any compound which produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzenemonohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance when used in any laundry application.

Typically, the compositions herein comprise from 0.01% to 20% by weight of the total composition of said peroxygen bleach or mixtures thereof, preferably from 1% to 15% and more preferably from 2% to 10%.

Salt Free Zwitterionic Betaine Surfactant

As a second essential element the compositions according to the present invention comprise a salt free zwitterionic betaine surfactant or a mixture thereof.

Typically, the compositions of the present invention comprise from 0.001% to 20% by weight of the total composition of a salt free zwitterionic betaine surfactant or a mixture thereof, preferably from 0.01% to 10% by weight, more preferably from 0.5% to 8% and most preferably from 1% to 5%.

By "salt free zwitterionic betaine surfactants", it is meant herein that the zwitterionic betaine surfactant (raw material) herein contains less than 5% by weight of salts, preferably less than 3%, more preferably less than 2%, even more preferably less than 1% and most preferably from 0.01% to 0.5%.

By "salts" is in meant herein any material having as base unit, a couple made of positive ion (or positive molecular ion) and negative ion (or negative molecular ion) containing one or more halogen atoms. Such salts include sodium chloride, potassium chloride, sodium bromide and the like.

Such salts free zwitterionic betaine surfactants are obtainable by conventional manufacturing processes like inverse osmosis or fractionated precipitation. For example inverse osmosis is based on the principle of contacting the zwitterionic betaine surfactant raw material (commercially available) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e. the salts is subtracted from the raw material.

Suitable salt free zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is C1–C4 sulfonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Examples of particularly suitable alkyldimethyl betaines include coconut-dimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine.

Examples of amidobetaines include cocoamidoethylbetaine, cocoamidopropyl betaine or C10–C14 fatty acylamidopropylene(hydropropylene) sulfobetaine.

All these zwitterionic betaine surfactants contains less than 5% of salts.

It has now been found that these salt free zwitterionic betaine surfactants reduce the tensile strength loss when used instead of conventional zwitterionic betaine surfactants in a liquid peroxygen bleach-containing composition to bleach fabrics.

It has further been found that these salt free zwitterionic betaine surfactants reduce color damage (i.e., color change and/or decoloration) when used instead of conventional zwitterionic betaine surfactants in a liquid peroxygen bleach-containing composition to bleach fabrics.

The reduced tensile strength loss and reduced color damage are observed even if the composition is left onto the soiled coloured fabrics upon prolonged periods of time before rinsing or washing then rinsing the fabrics, e.g. 24 hours. Actually, the presence of these salt free zwilterionic betaine surfactants in a peroxygen bleach-containing composition prevents the decomposition (oxidation) of dyes generally present on the surface of coloured fabrics such as bleach sensitive dyes and/or metallized dyes including copper-formazan dyes and/or metal-azo dyes.

It is speculated that the presence of salts in the zwitterionic betaine surfactants, i.e. the halides like Cl—, Br— and the like, catalyses the radical decomposition of peroxygen bleaches like hydrogen peroxide and oxidation. Thus, it is believed that a radical reaction occurs on the surface of the fabrics with generation of free radicals, which results in loss of tensile strength and/or colour damage. Using the salts free zwitterionic betaine surfactants reduces the radical and oxidative decomposition of the peroxygen bleach, and thus results in reduced tensile strength loss and reduced colour damage.

The tensile strength in a fabric may be measured by stretching said fabric until it breaks. The force needed to break the fabric is the "Ultimate Tensile Stress" and may be measured with a stress-strain INSTRON® machine available from INSTRON. The loss of tensile strength is the difference between the tensile strength of a fabric taken as a reference, e.g. a fabric which has not been bleached, and the tensile strength of the same fabric after having been bleached with a composition of the present invention. A tensile strength loss of zero means that no fabric damage is observed.

The colour safety can be evaluated visually by comparing side by side fabrics pretreated with a composition of the present invention and the reference composition. Differences and graduations in colour can be visually assessed and ranked according to Panel Score Units (PSU) using any suitable scale. PSU data can be handled statistically using conventional techniques. Alternatively, various types of optical apparatus and procedures can be used to assess the improvement in colour safety afforded by the present invention. For example when evaluating colour safety on fabrics measurements with Hunterlab colour Quest 45/0 apparatus can be used.

Importantly, the liquid compositions herein are clear and transparent compositions.

The appearance of a composition can be evaluated via turbidimetric analysis. For example, the transparency of a composition can be evaluated by measuring its absorbency via a spectrophotometer at 800 nm wave length.

An advantage of the liquid compositions of the present invention is that they are physically and chamically stable upon prolonged periods of storage.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

By "physically stable", it is meant herein that no phase separation occurs in the compositions for a period of 7 days at 50° C.

Optional Ingredients

The compositions herein may further comprise a variety of other optional ingredients such as chelating agents, builders, other surfactants, stabilisers, bleach activators, soil suspenders, soil suspending polyamine polymers, polymeric soil release agents, radical scavengers, catalysts, dye transfer agents, solvents, brighteners, perfumes, pigments and dyes.

Surfactants

The compositions of the present invention may further comprise other surfactants than the ones mentioned hereinbefore including nonionic surfactants, anionic surfactants, cationic surfactants and/or amphoteric surfactants.

Typically, the compositions according to the present invention may comprise from 0.01% to 30% by weight of the total composition of another surfactant on top of the salt free zwitterionic betaine surfactant, preferably from 0.1% to 25% and more preferably from 0.5% to 20%.

Particularly preferred surfactants herein are nonionic surfactants like alkoxylated nonionic surfactants. Suitable ethoxylated nonionic surfactants herein are ethoxylated nonionic surfactants according to the formula RO—$(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol$^R$ 91-2.5 (HLB=8.1; R is a mixture of C9 and $C_{11}$ alkyl chains, n is 2.5), or Lutensol$^R$ TO3 (HLB=8; R is a $C_{13}$ alkyl chains, n is 3), or Lutensol$^R$ AO3 (HLB=8; R is a mixture of $C_{13}$ and $C_{15}$ alkyl chains, n is 3), or Tergitol$^R$ 25L3 (HLB=7.7; R is in the range of $C_{12}$ to $C_{15}$ alkyl chain length, n is 3), or Dobanol$^R$ 23-3 (HLB=8.1; R is a mixture of $C_{12}$ and $C_{13}$ alkyl chains, n is 3), or Dobanol$^R$ 23-2 (HLB=6.2; R is a mixture of $C_{12}$ and $C_{13}$ alkyl chains, n is 2), or Dobanol$^R$ 45-7 (HLB=11.6; R is a mixture of $C_{14}$ and $C_{15}$ alkyl chains, n is 7) Dobanol$^R$ 23-6.5 (HLB=11.9; R is a mixture of $C_{12}$ and $C_{13}$ alkyl chains, n is 6.5), or Dobanol$^R$ 25-7 (HLB=12; R is a mixture of $C_{12}$ and $C_{15}$ alkyl chains, n is 7), or Dobanol$^R$ 91-5 (HLB=11.6; R is a mixture of $C_9$ and $C_{11}$ alkyl chains, n is 5), or Dobanol$^R$ 91-6 (HLB=12.5 ; R is a mixture of $C_9$ and $C_{11}$ alkyl chains, n is 6), or Dobanol$^R$ 91-8 (HLB=13.7; R is a mixture of $C_9$ and $C_{11}$ alkyl chains, n is 8), Dobanol$^R$ 91-10 (HLB=14.2 ; R is a mixture of $C_9$ to $C_{11}$ alkyl chains, n is 10), or mixtures thereof. Preferred herein are Dobanol$^R$ 91-2.5 , or Lutensol$^R$ TO3, or Lutensol$^R$ AO3, or Tergitol$^R$ 25L3, or Dobanol$^R$ 23-3, or Dobanol$^R$ 23-2, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

Suitable chemical processes for preparing the ethoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

The ethoxylated nonionic surfactants herein have the ability to further boost the stain removal performance delivered by the salt free betaine zwitterionic surfactants herein on greasy stains, while providing improved bleaching performance to the liquid peroxygen bleach-containing compositions of the present invention comprising them.

Indeed, a significant cooperation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

In a preferred embodiment herein optimum stain removal performance and bleaching performance are obtained when the ethoxylated nonionic surfactant and the salt free zwitterionic betaine surfactant are present in the compositions of the present invention comprising a peroxygen bleach (pH up to 7), at weight ratio of the ethoxylated nonionic surfactant to the salt free zwitterionic betaine surfactant of from 0.01 to 20, preferably from 0.1 to 15, more preferably from 0.5 to 5 and most preferably from 0.8 to 3.

Advantageously, excellent stain removal performance and bleaching performance can be obtained with the compositions herein at low total level of surfactants. Typically, the compositions herein comprise from 0.01% to 35% by weight of the total composition of ethoxylated nonionic surfactant and salt free zwitterionic betaine surfactant, preferably from 0.1% to 15%, more preferably from 0.5% to 10%, even more preferably below 10% and most preferably from 1% to 8%.

The use of ethoxylated nonionic surfactant on top of the salt free zwitterionic betaine surfactant, in a liquid aqueous composition comprising a peroxygen bleach (pH up to 7), boosts the bleaching performance and the removal of various types of stains including greasy stains (e.g., lipstick, olive oil, mayonnaise, vegetal oil, sebum, make-up), as compared to the bleaching and stain removal performance delivered by the same composition based only on one of these surfactants (i.e., ethoxylated nonionic surfactant or zwitterionic betaine surfactant) at equal total level of surfactants. For example, it is only at very high levels of salt free zwitterionic betaine surfactants, as compared the total level of ethoxylated nonionic surfactants and salt free zwitterionic betaine surfactants present in the compositions of the present invention that similar grease cleaning benefit is observed.

The stain removal performance may be evaluated by the following test methods on various type of stains.

A suitable test method for evaluating the stain removal performance on a soiled fabric for example under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference, e.g., the same composition but comprising only an alkoxylated nonionic surfactant or only a salt free zwitterionic betaine surfactant as the sole surfactant. A visual grading may be used to assign difference in panel units (psu) in a range from 0 to 4.

The bleaching performance may be evaluated as for the stain removal performance but the stains used are bleachable stains like coffee, tea and the like.

Other suitable nonionic surfactants to be used herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2—(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2—(CHOH)_4—CH_2OH$.

In formula $R^2—C(O)—N(R^1)—Z$, $R^1$ can be, for example, N-methyl, N-ethyl, N-propyl, N-isopropyl, N-butyl, N-2-hydroxy ethyl, or N-2-hydroxy propyl. $R^2—C(O)—N<$ can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium, and quaternary ammonium cations, such as tetramethyl-ammonium dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

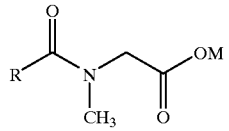

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

Chelating Agents

In a preferred embodiment of the present invention the ionic strength of the compositions is higher than $1.10^{-4}$ M, preferably higher than $5.10^{-3}$ M, and more preferably higher than $1.10^{-3}$ M. Indeed, it has been observed that formulating the compositions of the present invention with such high ionic strength further contributes to improved stain removal performance and improved bleaching performance. The higher the ionic strength the better the stain removal and bleaching performance. Indeed, it is speculated that under the preferred pH conditions of the present compositions (acidic to neutral), especially when the pH of the composition is higher than the pka of the salt free zwitterionic betaine surfactant present therein, said surfactant is in a dipolar form and its packing is strongly influenced by the ionic strength.

The ionic strength of a composition may be increased by the addition of various ingredients like chelating agents or mixtures thereof.

Accordingly, the compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to the benefits of the present compositions, i.e., to reduce the tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotriacetates, ethylenediamine tetrapropionates, triethylenetetraaminehexaacetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

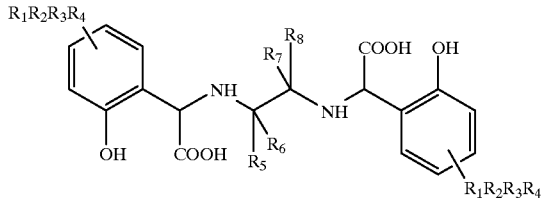

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition and preferably from 0.001% to 0.5% by weight.

The presence of radical scavengers may contribute to the benefits of the present compositions, i.e., to reduce tensile strength loss of fabrics and/or color damage when the compositions of the present invention are used in any laundry application, especially in a laundry pretreatment application.

Antioxidants

The compositions according to the present invention may further comprise an antioxidant or mixtures thereof. Typically, the compositions herein comprise up to 10% by weight of the total composition of an antioxidant or mixtures thereof, preferably from 0.002% to 5%, more preferably from 0.005% to 2%, and most preferably from 0.01% to 1%.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activators

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%

Process of Pretreating Fabrics

In the present invention, the liquid composition of the present invention is applied neat onto at least a portion of a soiled fabric, optionally left to act onto said fabric, typically for a period of time of a few seconds to several hours, before the fabric is rinsed, or washed then rinsed.

In this mode, the neat compositions can optionally be left to act onto said fabrics for a period of time ranging from 10 seconds to 1 hour, preferably 1 minute to 15 minutes, more preferably 1 minute to 5 minutes before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

By "washing", it is to be understood herein that the fabrics are contacted with a conventional detergent composition comprising at least one surface active agent in an aqueous bath, this washing may occur by means of a washing machine or simply by hands.

By "in its neat form", it is to be understood that the liquid compositions are applied directly onto the fabrics to be pretreated without undergoing any dilution, i.e. the liquid compositions herein are applied onto the fabrics as described herein.

According to the process of pretreating soiled fabrics of the present invention, the liquid aqueous compositions herein should preferably not be left to dry onto the fabrics. It has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabrics, in a process of pretreating soiled fabrics, contributes to reduce the tensile strength loss and/or colour damage when pretreating fabrics with liquid peroxygen bleach-containing compositions.

The compositions herein may also be used in a "soaking mode" where a composition, as defined herein, is first diluted in an aqueous bath and the fabrics are immersed and soaked in the bath, before they are rinsed, or in a "through the wash mode", where a composition, as defined herein, is added on top of a wash liquor formed by dissolution or dispersion of a typical laundry detergent. It is also essential in both cases, that the fabrics be rinsed after they have been contacted with said composition, before said composition has completely dried off.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Depending on the end-use envisioned, the compositions herein can be packaged in a variety of containers including conventional bottles, bottles equipped with roll-on, sponge, brusher or sprayers.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 91-10 | — | — | — | 1.6 | — | — | 1.6 | — |
| Dobanol ® | — | 2.0 | 1.6 | — | 2.6 | 1.6 | — | 2.0 |

-continued

| Compositions | I | II | III | IV | V | VI | VII | VIII |
|---|---|---|---|---|---|---|---|---|
| 45-7 | | | | | | | | |
| Dobanol ® 23-3 | — | — | 2.0 | 2.0 | 1.0 | 2.0 | 2.0 | — |
| Salt-free Betaine* | 5.0 | 2.4 | 2.4 | 2.4 | 2.4 | 5.0 | 5.0 | 5.0 |
| $H_2O_2$ | 7.0 | 7.0 | 6.0 | 7.0 | 5.8 | 7.0 | 7.0 | 7.0 |
| HEDP | 0.16 | — | 0.16 | — | 0.16 | 0.16 | 0.16 | 0.16 |
| DTPMP | — | 0.18 | — | 0.18 | — | — | — | — |
| Propyl gallate | 0.1 | 0.1 | — | — | — | 0.1 | 0.1 | 0.1 |
| BHT | — | — | 0.1 | 0.1 | 0.1 | — | — | — |
| Citric acid | 0.05 | 0.05 | 0.50 | 0.05 | 0.50 | 0.05 | 0.05 | 0.05 |
| Water and minors | | | | up to 100% | | | | |
| H2SO4 up to pH 4 or 5 | | | | | | | | |

HEDP is 1-hydroxy-ethane diphosphonate.

DTPMP is diethylene triamine penta methylene phosphonate.

BHT is di-tert-butyl hydroxy toluene

Salt-free Betaine* is Lauryl di-methyl betaine containing 0.3% by weight of sodium chloride. This betaine is obtainable by purification from commercially available Lauryl di-methyl betaine GENAGEN LAB® (Hoechst) (which contains 7.5% of sodium chloride).

Compositions I to VIII when used to bleach soiled coloured fabrics exhibit excellent overall stain removal performance especially on greasy stains like lipstick, make-up, olive oil, mayonnaise, sebum and the like, and excellent bleaching performance while being safe to both the fabrics and colors.

When used in a pretreatment mode, any of the compositions I to VIII is applied neat on the stained portion of a fabric and left to act thereon for 5 minutes. Then the fabric is washed with a conventional detergent and rinsed.

When used in a bleaching-through-the-wash mode, any of the compositions I to VIII is contacted with an aqueous bath formed by dissolution of a conventional detergent in water. Fabrics are then contacted with the aqueous bath comprising the liquid detergent, and the fabrics are rinsed. They can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed.

What is claimed is:

1. A liquid bleaching composition comprising:

a) from 0.01% to 20% by weight, of a peroxygen bleach; and b) from 0.001% to 20% by weight, of a zwitterionic betaine surfactant which comprises less than 5% by weight, of salts.

2. A composition according to claim 1 wherein said composition comprises from 0.01% to 10% by weight, of said surfactant.

3. A composition according to claim 2 wherein said composition comprises from 0.5% to 8% by weight, of said surfactant.

4. A composition according to claim 3 wherein said composition comprises from 1% to 5% by weight, of said surfactant.

5. A composition according to claim 1 wherein said composition comprises from 1% to 15% by weight, of said peroxygen bleach.

6. A composition according to claim 5 wherein said composition comprises from 2% to 10% by weight, of said peroxygen bleach.

7. A composition according to claim 1 wherein said surfactant has the formula:

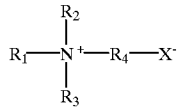

wherein $R_1$ has the formula:

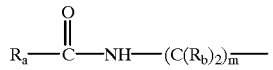

$R_a$ is $C_8$–$C_{20}$ saturated or unsaturated aliphatic, $C_8$–$C_{20}$ substituted or unsubstituted aliphatic, $C_8$–$C_{20}$ substituted or unsubstituted aromatic; and mixtures thereof; $R_b$ is hydrogen, hydroxyl, or mixtures thereof; m is from 1 to 4; $R_2$ and $R_3$ are each independently hydrogen, $C_1$–$C_6$ alkyl, $C_1$–$C_6$ substituted alkyl, $C_1$–$C_6$ hydroxy alkyl, $C_1$–$C_6$ sulfonate, and mixtures thereof; or $R_2$ and $R_3$ can be taken together to form a ring which includes the N atom; $R_4$ is $C_1$–$C_{10}$ alkylene, $C_1$–$C_{10}$ hydroxy alkylene, $C_1$–$C_{10}$ polyalkyleneoxy, and mixtures thereof; X is carboxylate, sulfonate, and mixtures thereof.

8. A composition according to claim 7 wherein $R_a$ is $C_8$–$C_{18}$ alkyl.

9. A composition according to claim 8 wherein $R_a$ is $C_8$–$C_{16}$ alkyl.

10. A composition according to claim 7 wherein m is 2 or 3.

11. A composition according to claim 10 wherein m is 3.

12. A composition according to claim 1 wherein said peroxygen bleach is hydrogen peroxide or a source of hydrogen peroxide selected from the group consisting of percarbonates, persilicates, persulphates, peroxyacids, hydroperoxides, diacyl peroxides, and mixtures thereof.

13. A composition according to claim 12 wherein said hydroperoxides are selected from the group consisting of tert-butyl hydroperoxide, cumyl hydroperoxide, 2,4,4-trimethylpentyl-2-hydroperoxide, di-isopropylbenzene monohydroperoxide, tert-amyl hydroperoxid, and 2,5-dimethyl hexane-2,5-dihydroperoxide.

14. A composition according to claim 12 wherein said diacyl peroxide is selected from the group consisting of dilauroyl peroxide, didecanoyl peroxide, dimyristoyl peroxide, and mixtures thereof.

15. A composition according to claim 1 wherein said surfactant comprises less than 3% by weight, of salt.

16. A composition according to claim 15 wherein said surfactant comprises less than 2% by weight, of salt.

17. A composition according to claim 16 wherein said surfactant comprises less than 1% by weight, of salt.

18. A composition according to claim 17 wherein said surfactant comprises from 0.01% to 0.5% by weight, of salt.

19. A composition according to claim 1 further comprising from 0.1% to 25% by weight, of a nonionic surfactant having the formula:

$$RO—(C_2H_4O)_nH$$

wherein R is $C_6$–$C_{22}$ alkyl, $C_6$–$C_{28}$ alkyl benzene, and mixtures thereof; n is from to 20.

20. A composition according to claim 1 further comprising from about 0.01% to 1.5% by weight of a chelating agent selected from the group consisting of phosphonates, amino carboxylates, polyfunctionally-substituted aromatic, ethylenediamine-N,N'-disuccinic acid, or mixtures thereof.

* * * * *